US009140089B2

(12) United States Patent
Strand

(10) Patent No.: US 9,140,089 B2
(45) Date of Patent: Sep. 22, 2015

(54) DEVICE AND METHOD FOR STABILIZATION OF A WELLHEAD

(75) Inventor: Harald Strand, Algard (NO)

(73) Assignee: NeoDrill AS, Algard (NO)

( * ) Notice: Subject to any disclaimer, the term of this patent is extended or adjusted under 35 U.S.C. 154(b) by 248 days.

(21) Appl. No.: 13/701,817

(22) PCT Filed: Jun. 20, 2011

(86) PCT No.: PCT/NO2011/000176

§ 371 (c)(1),
(2), (4) Date: Jan. 14, 2013

(87) PCT Pub. No.: WO2011/162616

PCT Pub. Date: Dec. 29, 2011

(65) Prior Publication Data

US 2013/0105171 A1 May 2, 2013

(30) Foreign Application Priority Data

Jun. 22, 2010 (NO) ..... 20100899

(51) Int. Cl.
*E21B 33/035* (2006.01)

(52) U.S. Cl.
CPC ..... *E21B 33/035* (2013.01)

(58) Field of Classification Search
CPC ..... E21B 33/035; E21B 33/06; E21B 33/043; E02D 27/32; E02D 27/52; E02D 27/12
USPC ..... 405/227, 203, 208, 226, 229, 239, 249; 166/335, 363–364, 368
See application file for complete search history.

(56) References Cited

U.S. PATENT DOCUMENTS 2,009,888 A * 7/1935 Hild ..... 166/54
3,285,337 A * 11/1966 Johnstone et al. ..... 166/358

(Continued)

FOREIGN PATENT DOCUMENTS

EP 1 837 482 A1 9/2007
NO 305179 B1 4/1999

(Continued)

OTHER PUBLICATIONS

Asgeir Kristian Dahl Lien, "Methods to Improve Subsea Wellhead Fatigue Life", a project assignment at the Faculty of Engineering and Technology, the Department of Petroleum Engineering and Applied Geophysics, NTNU, Trondheim, Dec. 17, 2009, 48 pages.
International Search Report for parent application PCT/NO2011/000176, having a mailing date of Oct. 5, 2011.

(Continued)

*Primary Examiner* — James G Sayre
(74) *Attorney, Agent, or Firm* — Andrus Intellectual Property Law, LLP

(57) ABSTRACT

A stabilization device is for a wellhead wherein an upper portion of a wellhead casing extends up above a seabed, the upper wellhead casing portion being sideways supported in a suction substructure. A blowout preventer extending up from the upper portion of the wellhead casing is provided with multiple supporting elements abutting supportingly an edge portion of an end cover on the suction substructure. A method is for stabilizing a wellhead wherein an upper portion of a wellhead casing extends up above a seabed and is sideways supported in a suction substructure surrounding the wellhead casing portion and extends downward in an uncompacted material.

11 Claims, 2 Drawing Sheets

(56) References Cited

U.S. PATENT DOCUMENTS

| | | | | |
|---|---|---|---|---|
| 3,324,943 | A * | 6/1967 | Price | 166/340 |
| 3,391,734 | A * | 7/1968 | Townsend, Jr. | 166/356 |
| 4,721,415 | A * | 1/1988 | Shatto | 405/224.1 |
| 4,830,541 | A * | 5/1989 | Shatto | 405/226 |
| 4,932,811 | A | 6/1990 | Folding | |
| 6,009,941 | A | 1/2000 | Haynes | |
| 2003/0029620 | A1 | 2/2003 | Strand | |

FOREIGN PATENT DOCUMENTS

| | | | |
|---|---|---|---|
| NO | 313340 | B1 | 9/2002 |
| NO | 328221 | B1 | 1/2010 |
| WO | 98/09050 | A1 | 3/1998 |

OTHER PUBLICATIONS

Written Opinion for parent application PCT/NO2011/000176, having a mailing date of Oct. 5, 2011.

* cited by examiner

DEVICE AND METHOD FOR STABILIZATION OF A WELLHEAD

CROSS-REFERENCE TO RELATED APPLICATIONS

This application is the U.S. national stage application of International Application No. PCT/NO2011/000176, filed Jun. 20, 2011, which International application was published on Dec. 29, 2011 as International Publication No. WO 2011/162616 A1 in the English language, and which application is incorporated herein by reference. The International application claims priority of Norwegian Patent Application No. 20100899, filed Jun. 22, 2010, which application is incorporated herein by reference.

BACKGROUND

There is described a device for stabilization of a wellhead where the upper portion of a wellhead casing projects up above a seabed, the upper wellhead casing portion being sideways supported in a suction substructure, more particularly in that a blowout preventer valve projecting up from the upper wellhead casing portion, is provided with multiple support elements abutting supportingly against an edge portion of an end cover on the suction substructure. Also described is a method for stabilizing a wellhead, an upper portion of a wellhead casing projecting up above a seabed and being sideways supported in a suction substructure surrounding the wellhead casing portion and extending downward in an uncompacted material. Finally the use of a suction substructure for support of a wellhead is described.

Installation of elements on a wellhead, particularly a blowout preventer valve (BOP), on top of a wellhead casing extending down through uncompacted materials in the seabed, generally with an upper portion of the wellhead casing surrounded by and fastened in a conductor casing, normally involves a risk for fatigue of the wellhead casing in that sideways forces are applied to the wellhead so that the wellhead casing is being bent. The side loading may occur as a result of drift of a riser extending up through the mass of water from the wellhead and up to a surface installation. When a blow out preventer weighs 250-500 tons and has a vertical extent of up to 14-16 meters and a horizontal extent of 5-6 meters, such a bending strain will increase by the load resting on the wellhead casing having its centre of gravity displaced away from the original vertical central axis of the wellhead. The problem is described inter alia by Dahl Lien: "Methods to Improve Subsea Wellhead Fatigue Life", a project assignment at the Faculty for engineering science and technology, the Institute for petroleum technology and applied geophysics, NTNU, Trondheim 2009. The situation may lead to deformation of the wellhead casing and at worst fatigue failure.

From prior art describing solutions to the problem of fatigue of the wellhead casing forming a substructure for wellhead elements, the present inventors own suction substructure (Conductor Anchor Node=CAN), described in NO patent 313340, may be mentioned, in its entirety included here by reference, and which in principle provides a larger contact surface between the upper part of the conductor casing and the surrounding seabed mass, the diameter of the suction substructure typically being 8 meters, while the conductor casing diameter is in the range 0.75-0.90 m (30-36 inches).

In NO 328221 the "Vasshella Flexible Casing Joint" (VFC) is described as a device for a combined wellhead and pipe string arranged to be set down in an outer casing being installed in a well bore in the seabed, an articulated joint being introduced between the casing string and the wellhead, the joint being able to transfer axially acting forces at the same time as it cancels bending moments on the wellhead casing.

It is also known (Dahl Lien 2009) to use moorings extending aslant outward and downward from an upper portion of a wellhead installation to the seabed where the moorings are fastened to anchors.

From NO 305179 is known a suction anchor surrounding an upper portion of a conductor casing and parts of a wellhead. To the wellhead is connected a frame arranged to carry a swivel device for horizontal connection of a riser etc., and the frame rests on separate suction anchors placed at a distance from the first mentioned suction anchor.

In the further description the term "wellhead valve" comprises both a blowout preventer (BOP) alone and also a combination of a blowout preventer and other types of valves (for example production valves), and other types of valves or valve type combinations alone, as said wellhead valve is arranged on a wellhead on an end portion of a wellhead casing projecting up above a seabed.

SUMMARY

The object of the invention is to remedy or reduce at least one of the disadvantages of the prior art, or at least to provide a useful alternative to the prior art.

The object is achieved by the features disclosed in the below description and in the subsequent claims.

The invention provides a method and a device for stabilization of a wellhead, a wellhead valve resting on a wellhead casing supported in uncompacted material above an underground structure and extending above the uncompacted material, being supported by one or more supporting elements extending between the wellhead valve and a portion of a substructure surrounding an upper portion of the wellhead casing, the support elements being arranged remote from a central axis of the wellhead casing. The substructure is a suction substructure formed by a polygonal or cylindrical substructure element which in an upper end portion is essentially closed by an end cover arranged to be able to take up a vertical load and to transfer a horizontally directed load component from a wellhead casing extending through the end cover and to the substructure element.

The support elements are preferably arranged to rest on an enforced, peripheral portion of the end cover.

In a first aspect the invention relates more specifically to a stabilization device for a wellhead having a wellhead casing upper portion extending up above a seabed, where the upper wellhead casing portion is sideways supported in a suction substructure, characterized in that a wellhead valve extending up from the upper portion of the wellhead casing is supported fully or partly on the suction substructure, multiple supporting elements being arranged between the blowout preventer and the suction substructure.

The supporting elements may supportingly abut an edge portion of an end cover on the suction substructure.

The edge portion may be an annular end cover reinforcement. Thereby the blowout preventer may be turned an arbitrary angle about the wellhead casing central axis relative to the suction substructure and thereby simplify the positioning of the blowout preventer.

One or more of the supporting elements may be telescopic. The bracing may thereby be adapted to varying distances between the blowout preventer and the end cover.

One or more of the supporting elements may be provided with a linear actuator. Tensioning of the supporting elements may thereby be done in a simpler way and by remote operation.

In a second aspect the invention relates more specifically to a method for stabilizing a wellhead where the upper portion of a wellhead casing extends up above a seabed by a) supporting the upper portion of the wellhead casing sideways in a suction substructure surrounding the wellhead casing portion and extending down into an uncompacted material; and b) arranging a blowout preventer extending up from the upper portion of the wellhead casing; characterized in that the method further comprises the following step of:

c) arranging multiple supporting elements between the blowout preventer and an edge portion of the suction substructure distributed along the horizontal circumference of the suction substructure.

The method may further comprise the following step:

d1) the supporting elements are tightened to stable supporting of the blowout preventer against the suction substructure. A blowout preventer with a traditional connection against the wellhead casing will thereby be able to be satisfactorily supported independently of the height of the blowout preventer above the suction substructure.

Alternatively the method may further comprise the following step:

d2) the blowout preventer is lowered on to the wellhead casing by adjusting a wellhead casing connector arranged on the blowout preventer until the blowout preventer is stably supported on the suction substructure. Simpler supporting elements may thereby be used.

In yet an alternative embodiment the method may further comprise the following step:

d3) fastening the blowout preventer on the wellhead casing and subsequently provide an overpressure internally in the suction substructure, thereby displacing the suction substructure in a vertical direction until the blowout preventer is stably supported on the suction substructure.

In a third aspect the invention relates more specifically to use of a suction substructure arranged as sideways support for an upper wellhead casing portion in an uncompacted material as support for a blowout preventer, as multiple supporting elements are arranged between the blowout preventer and the suction substructure.

BRIEF DESCRIPTION OF THE DRAWINGS

In the following is described an example of a preferred embodiment illustrated in the accompanying drawings, where.

DETAILED DESCRIPTION OF THE DRAWINGS

Figure 1:
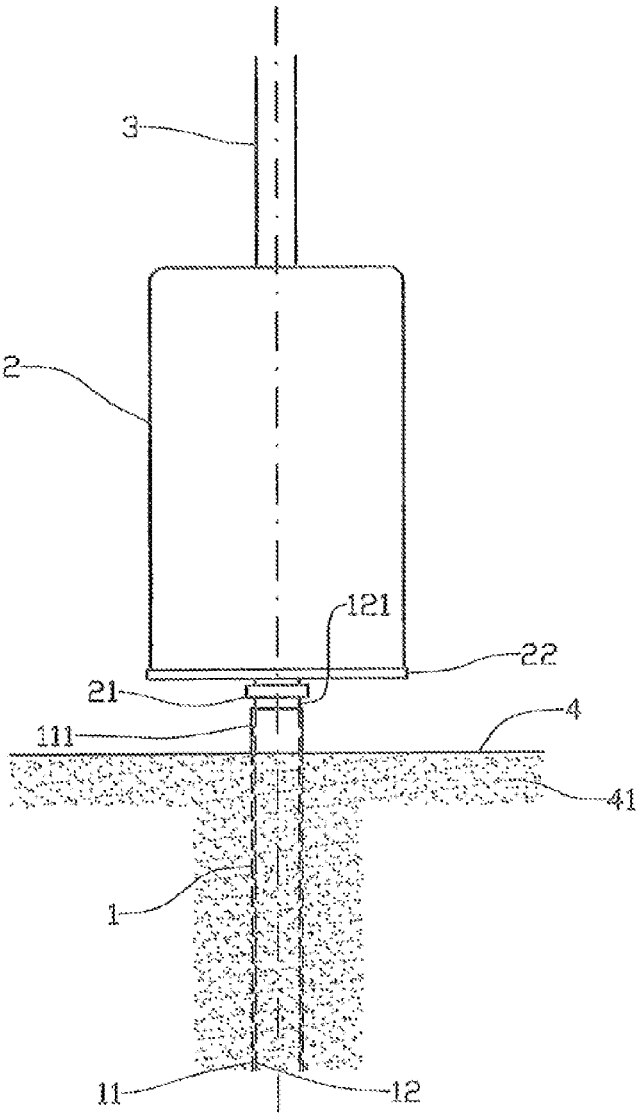
Fig. 1 PRIOR ART
FIG. 1 shows schematically a side view of a wellhead according to prior art, where a blowout preventer is arranged on top of a wellhead casing.

In the Figures the reference numeral 1 indicates a wellhead formed by a per se known conductor casing 11 defining a bore-hole against an uncompacted material 41 extending downward from a seabed 4 toward an underground formation (not shown) which is of interest for such as exploitation of oil and/or gas, and where a wellhead casing 12 which in a per se manner forms a pressure barrier, is arranged internally in the conductor casing 11.

An upper end portion 121 of the wellhead casing 12 extends up above an upper conductor casing portion 111 and forms the proper wellhead 1 where a blowout preventer (BOP) 2 is arranged and possibly other appropriate wellhead valves (not shown). The blowout preventer 2 is provided with a wellhead connector 21 arranged to fixedly hold the blowout preventer on the end of the wellhead casing 12. The blowout preventer 2 is typically provided with a frame 22 such as being used when the blowout preventer 2 is moved during transport onshore, here shown schematically.

A riser 3 is connected to the blowout preventer 2 and forms in a per se known manner a connection to a surface installation (not shown).

Figure 2:
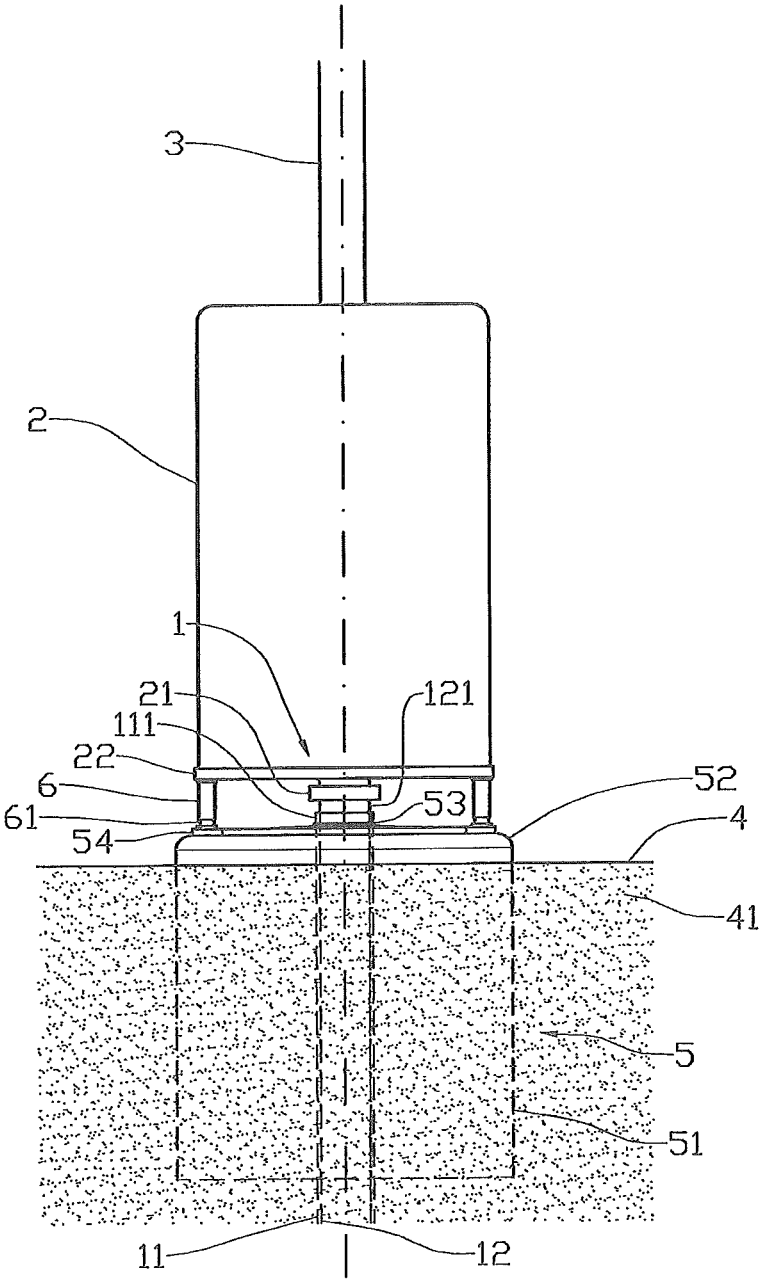
FIG. 2 shows schematically a side view of a wellhead provided with a suction substructure providing support for supporting elements arranged under a blowout preventer.

In the following reference is made to FIG. 2. A wellhead substructure 5 of the suction substructure type (in its entirety described in NO 313340) is arranged surrounding the upper conductor casing portion 111. A cylinder element 51 having an open lower end extends downwardly in the uncompacted material 41, and an end cover 52 closes an upper end. The upper conductor casing portion 111 projects up through a conductor casing passage 53 and is supported in this. An annular end cover reinforcement 54 forms an edge portion on the end cover 52.

A plurality of supporting elements 6 are arranged between the blowout preventer 2 frame 22 and the suction substructure 5 end cover 52, as they are supported on the annular end cover reinforcement 54. By the very fact that the end cover reinforcement 54 is continuous, the supporting elements 6 may be placed in an arbitrary position on the end cover reinforcement 54, resulting in that the blowout preventer 2 during installation may be turned about its vertical axis independently of the horizontal position of the suction substructure 5. In the embodiment example shown the supporting element 6 is provided with a linear actuator 61 arranged to be able to be used when adjusting the length of the supporting element 6.

When a wellhead according to the invention is established, the suction substructure 5 and the conductor casing 11 are placed in the uncompacted material 41. A wellbore (not shown) is formed in a per se known manner, among others the wellhead casing 12 being cemented in the well bore wall formed in the underground structure (not shown) and fastened in the conductor casing 11. The blowout preventer 2 is mounted on the wellhead 1 by means of the wellhead connector 21. The supporting elements 6, placed extending downward from the blowout preventer 2 frame 22, are brought into contact with the end cover reinforcement 54. In the embodiment example shown the blowout preventer 2 is braced relative to the suction substructure 5, the length of the supporting elements 6 being adjusted individually by means of the respective linear actuators 61 which may be provided as hydraulic cylinders, threaded connections or the like.

In a not shown embodiment example the length of the supporting elements 6 may be non-adjustable, as the blowout preventer is first fastened to the wellhead 1 by means of the wellhead connector 21 subsequent to the blowout preventer 2 is placed with its supporting elements 6 resting on the suction substructure 5.

In yet another not shown embodiment example the length of the supporting elements 6 may be non-adjustable, as the blowout preventer 2 is fastened to the wellhead 1 by means of the wellhead connector 21, and the internals of the suction substructure 5 is subsequently supplied with a fluid, typically sea water, under high pressure such that the suction substructure 5 is forced up against the blowout preventer 2 until the supporting elements 6 rest on the suction substructure 5. The vertical position of the suction substructure may be checked and adjusted later as needed.

The invention claimed is:

1. A stabilization device for a wellhead having an upper portion of a wellhead casing extending up above a seabed, the upper wellhead casing portion being sideways supported in an underlying substructure extending into the seabed, wherein a blowout preventer extending up from the upper portion of the wellhead casing and joined thereto by a connector is supported fully or partly on the underlying substructure, multiple supporting elements being arranged between the underlying substructure and an outermost edge portion of the blowout preventer spaced apart and disengaged from the connector and the wellhead casing.

2. The device according to claim 1, wherein the supporting elements supportingly abut an edge portion of an end cover on the underlying substructure.

3. The device according to claim 1, wherein the edge portion is an annular end cover reinforcement.

4. The device according to claim 1, wherein one or more of the supporting elements are telescopic.

5. The device according to claim 1, one or more of the supporting elements are provided with a linear actuator.

6. The device according to claim 1, wherein the multiple supporting elements have lower ends in resting abutment upon an upper surface of the underlying substructure such that relative movement is permitted between the blowout preventer and the underlying substructure during installation of the blowout preventer.

7. A method for stabilizing a wellhead wherein an upper portion of a wellhead casing extends up above a seabed by a) sideways supporting the upper wellhead casing portion in an underlying substructure surrounding the wellhead casing portion and extending downward in an uncompacted material;

b) arranging a blowout preventer extending up from the upper portion of the wellhead casing and joined thereto by a connector; and c) arranging multiple supporting elements between an edge portion of the underlying substructure and an outermost edge portion of the blowout preventer spaced apart and disengaged from the connector and the wellhead casing.

8. The method according to claim 7, wherein the method further comprises d1) tightening the supporting elements to stabilize supporting of the blowout preventer against the underlying substructure.

9. The method according, to claim 7, wherein the method further comprises d2) lowering the blowout preventer on to the wellhead casing by adjusting a wellhead connector arranged on the blowout preventer until the blowout preventer is stably supported on the underlying substructure.

10. The method according to claim 7, wherein the method further comprises d3) fastening the blowout preventer on the wellhead casing and subsequently providing an overpressure internally in the underlying substructure, thereby displacing the underlying substructure in a vertical direction until the blowout preventer is stably supported on the underlying substructure.

11. A method for stabilizing a wellhead wherein an upper portion of a wellhead casing extends up above a seabed and is sideways supported in an underlying substructure positioned in an uncompacted material, the method comprising the steps of:

a) arranging a blowout preventer extending up from the upper portion of the wellhead casing and joined thereto by a connector; and b) arranging multiple supporting elements between an edge portion of the underlying substructure and an outermost edge portion of the blowout preventer spaced apart and disengaged from the connector and the wellhead casing.

* * * * *